US005634478A

United States Patent [19]

Shakir

[11] Patent Number: 5,634,478

[45] Date of Patent: Jun. 3, 1997

[54] METHOD FOR ATTACHING PRE-MANUFACTURED BRAIDS TO NATURAL HAIR ON THE SCALP

[76] Inventor: Jamilah Shakir, 2021 Rodeo Ct., Atlanta, Ga. 30316

[21] Appl. No.: 570,947

[22] Filed: Dec. 12, 1995

[51] Int. Cl.[6] ..... A41G 3/00

[52] U.S. Cl. ..... 132/201

[58] Field of Search ..... 132/201, 53, 54, 132/55, 56

[56] References Cited

U.S. PATENT DOCUMENTS 2,865,380 12/1958 Mitchell ..... 132/201
5,357,986 10/1994 Hargrett ..... 132/201

FOREIGN PATENT DOCUMENTS 611530 8/1984 European Pat. Off. ..... 132/201

OTHER PUBLICATIONS

Photograph of Braid Track, Nov. 1995.

*Primary Examiner*—Todd E. Manahan
*Attorney, Agent, or Firm*—Bernstein & Associates

[57] ABSTRACT

A method for attaching manufactured strands of hair (13) to natural hair on the scalp (15) to form pre-manufactured braids (16). The method comprises braiding a base plait (11) out of human, animal, or synthetic hair, anchoring additional strands of hair (13) to the base plait (11), braiding or twisting the additional strands in groups of two or three strands to form pre-manufactured braids (16), braiding the natural hair on the scalp (15) of the individual into horizontal or vertical rows (14), and attaching the base plait (11) to the rows of braids (14) on the scalp (15) of the individual.

15 Claims, 3 Drawing Sheets

METHOD FOR ATTACHING PRE-MANUFACTURED BRAIDS TO NATURAL HAIR ON THE SCALP

BACKGROUND OF THE INVENTION

1. Field of the Invention

The present invention relates generally to methods of braiding hair and particularly to a method for attaching pre-manufactured braids to natural hair on the scalp.

2. Description of the Related Art

In the art of hair design, the technique of braiding enables the hair stylist to create many designs depending on the characteristics of the client's hair. Braids are formed by interweaving strands of hair in an alternating fashion. The braid requires at least three strands of hair and is typically created by repeatedly crossing a left and then a right strand over a central strand and under an opposite strand. Hair that is characterized by thickness and long length provides the best material for braiding. On the other hand, hair that is very thin or very short is harder to braid.

By varying the length of the individual braids or by varying the direction in which the rows of braids are arranged, many different hair styles can be created. The direction of the braids may vary from horizontal across the head to vertical from the top of the head to the back of the head.

The primary drawbacks to braids are the amount of time involved in braiding the hair and the amount of time involved in removing the braids once the hair style is no longer desirable. These drawbacks become more prevalent as the length of the desired braids increases. Due to the fact that some of the most popular hair designs involve long braids, there is a need for long braids that can be easily added to existing hair without incurring the problems associated with the conventional method.

Also, there exists a need for a braided hair style that is available to individuals whose hair may not be suitable for braiding in the conventional manner. Individuals who have experienced balding, alopecia, or hair damage usually cannot wear braids formed by the traditional method because the weight of the braids can cause more damage.

SUMMARY OF THE INVENTION

The method of the present invention comprises a method for attaching pre-manufactured braids to natural hair on the scalp. Initially, the manufactured strands of hair are braided to form a base plait. The base plait may comprise human, animal, or synthetic hair. A set of additional strands of hair is anchored to the base plait to form anchored strands of hair extending therefrom. In order to anchor the strands to the base plait, the stylist loops a large strand of hair over the base plait, puts the two resulting ends on top of each other, divides the large strand into three smaller strands and braids the three strands.

The next step of the method is to braid the hair on the individual's head into horizontal or vertical braids which are commonly referred to as "corn rows.". After the rows of braids are formed, the base plait, with the anchored strands extending therefrom, is attached to the rows of braids on the scalp.

Accordingly, it is an object of the present invention to provide a method of attaching pre-manufactured strands of hair to natural hair.

Another object of the present invention is to minimize the time required to create braids.

It is a further object of the present invention to minimize the time required to remove braids.

It is yet a further object of the present invention to enable individuals that have not been able to have braids due to certain characteristics of their hair such as insufficient thickness, insufficient length or other conditions such as balding or thinning areas on the head, to have the benefit of braids.

It is an additional object of the present invention to enable individuals with damaged hair to have braids without subjecting their hair to the normal stress that is associated with having braids.

It is another object of the present invention to provide fullness and length to an individual's hair through the use of braids.

BRIEF DESCRIPTION OF THE DRAWINGS

The invention is illustrated in the drawings in which like reference numerals designate corresponding parts throughout the several figures of which.

DESCRIPTION OF THE PREFERRED EMBODIMENTS

Figure 1:
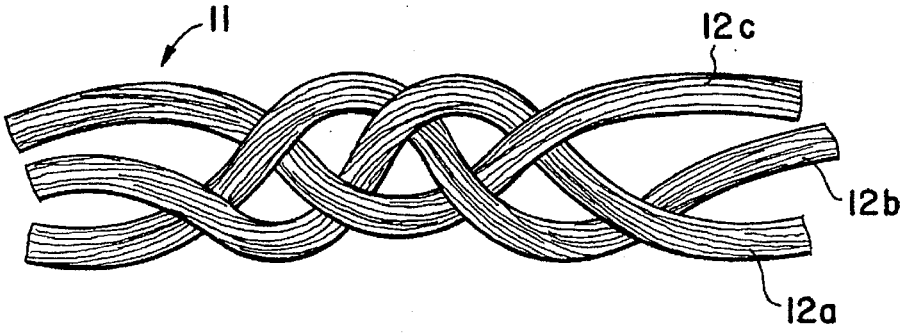
FIG. 1 is a perspective view of the base plait.

Referring to FIG. 1, the first step of the method is to construct a base plait 11. The base plait 11 is constructed of a plurality of manufactured strands 12*a*, 12*b*, and 12*c* of human, animal, or synthetic hair. The base plait 11 may be as short as an inch or as long as several inches. The minimum number of strands required for a braid is three, and therefore it is recommended that the base plait be constructed out of at least three strands of hair. Each strand 12*a*, 12*b*, and 12*c* is made out of literally thousands of hair fibers. As illustrated by following FIG. 1 from right to left, the plait 11 is formed by crossing a left strand 12*a* over a central strand 12*b* and under a right strand 12*c*, and then crossing the right strand 12*c* over the strand 12*a* and under the strand 12*b*. The sequence is characterized by repeatedly crossing a left positioned and then a right positioned strand over a center positioned strand and under the opposite of the left or right positioned strand. The left positioned strand, right positioned strand, and center positioned strand am defined by whichever of the three strands 12*a*, 12*b*, and 12*c* is positioned in the left, right or center position at the time the sequence is started for each link in the braid.

Figure 2A:
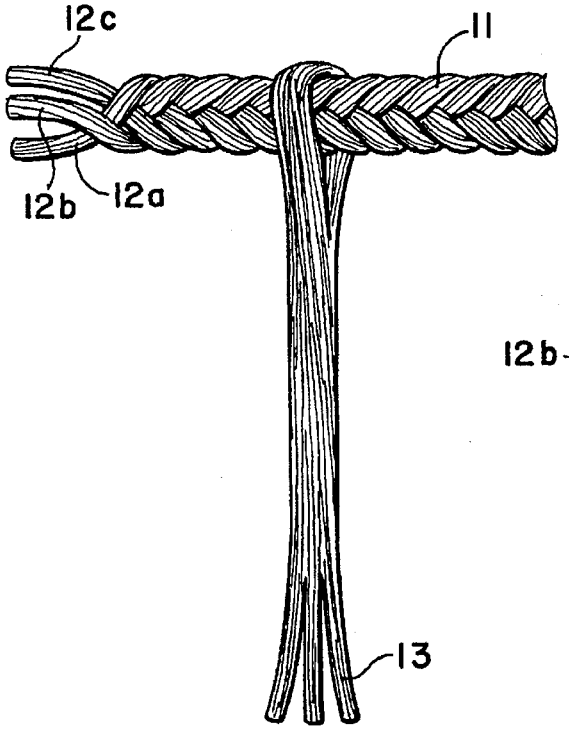
FIG. 2*a* is a perspective view of the pre-manufactured braids being anchored to the base plait.
Figure 2B:
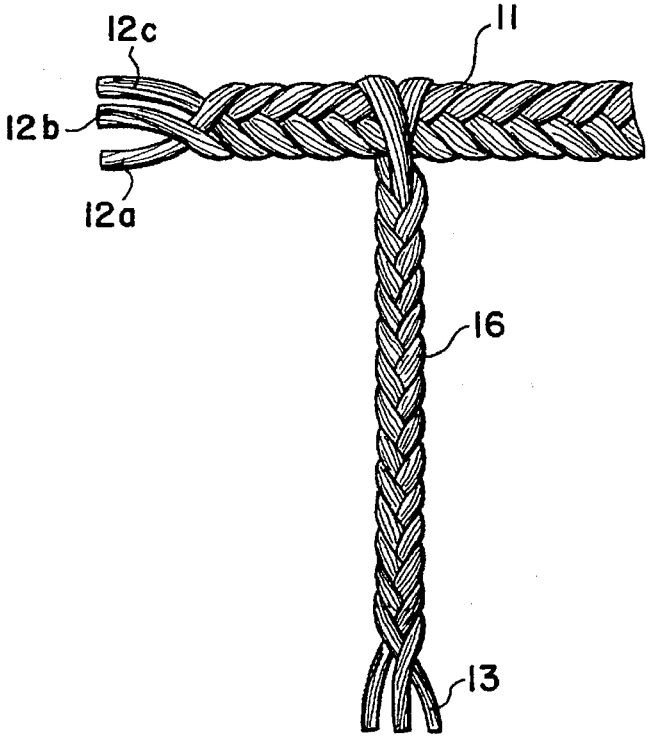
FIG. 2*b* is a perspective view of the pre-manufactured braids attached to the base plait.

In FIG. 2*a*, the second step of the method is illustrated whereby a second plurality of manufactured strands of hair 13 am looped over the base plait and then divided into three strands for braiding. The additional strands 13 may range from two inches to several feet in length and may be constructed of human, animal, or synthetic hair. The strands may be braided into three strand braids or two strand twists. In FIG. 2*b*, the method of forming braids 16 from strands 13 is shown. Having been looped and then braided, the braids 16 are free to rotate about the base plait 11. This rotation enables the braids to be turned upward easily. As a result, the braids 16 worn up have a sleeker profile than conventional braids. Other methods of attaching the pre-manufactured braids 16 to the base plait 11 such as attaching with adhesive substances may be used and would be acceptable as long as the braids 16 are not able to slide off of the end of the base plait 11.

Figure 3:
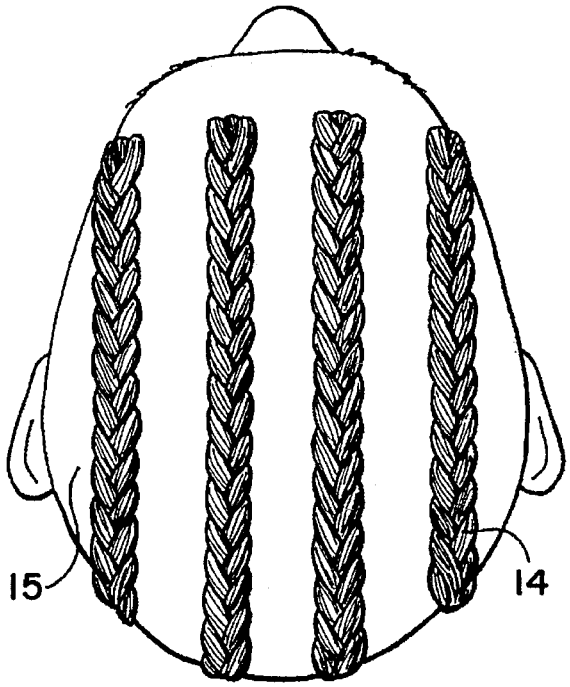
FIG. 3 is a top plan view of an individual's head with the rows of braids formed in their hair.

Turning to FIG. 3, the next step of the method requires that the natural hair on the scalp 15 be braided in rows 14 which are commonly known as "corn rows." The rows 14 may be oriented either horizontally, vertically, or in other arrangements.

Figure 4:
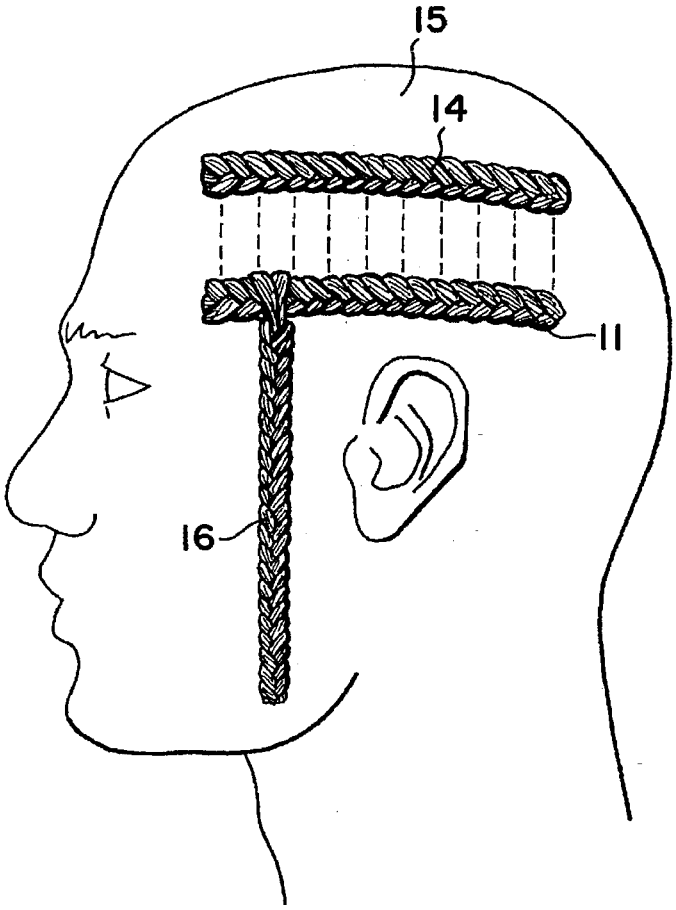
FIG. 4 is a side view of the head of an individual wearing the braids of the present invention.

FIG. 4 illustrates the placement of the base plait 11 onto the row of braids 14 on the scalp 15. The pre-manufactured braids 16 extend downward from the base plait 11.

Figure 5:
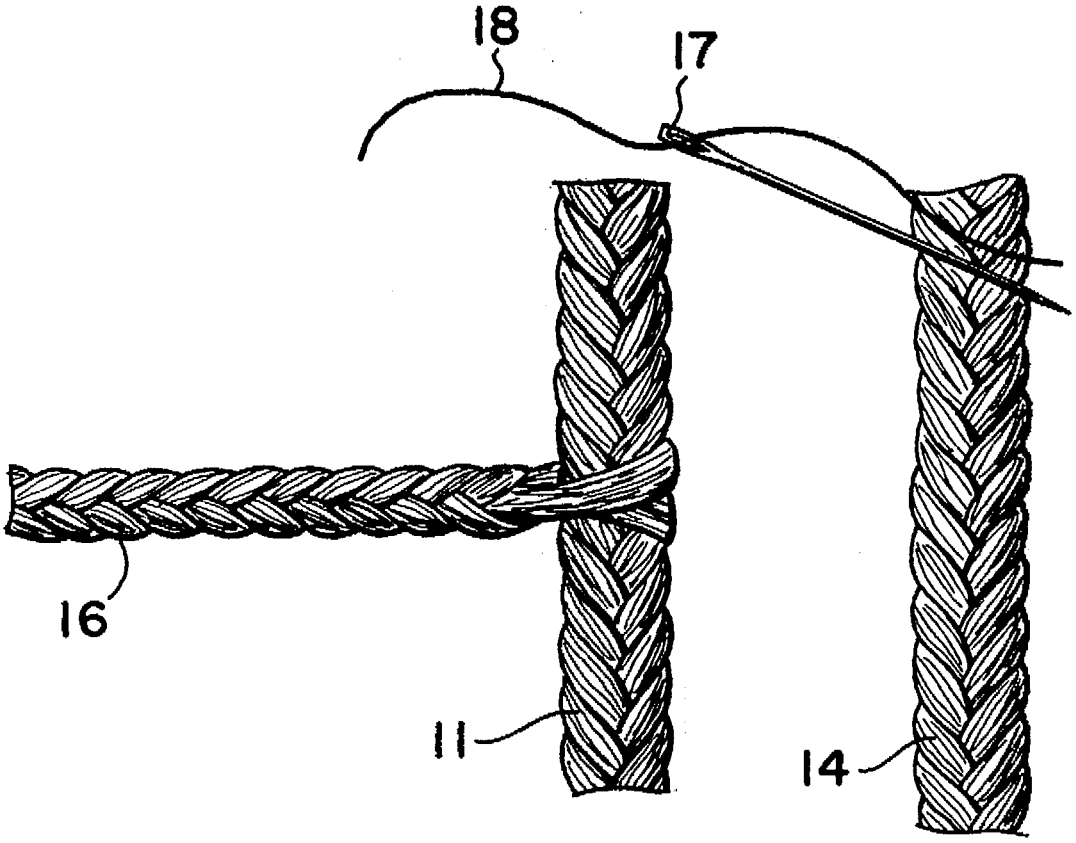
FIG. 5 is a perspective view of the base plait being attached to the natural row of braids with a needle and thread.

The final step is illustrated in FIG. 5 and comprises attaching the base plait 11, with the pre-manufactured braids 16 extending therefrom, to the natural rows of braids 14. The base plait 11 is preferably attached to the rows of braids 14 on the scalp 15 by a needle 17 and thread 18 in a secure locking stitch. Other ways of attaching the base plait 11 to the row of braids 14 may also be used including attaching with adhesive substances.

Accordingly, the method of the present invention offers many advantages over the prior an methods. The advantages include the fact that the present invention fills the need for long braids that can be easily added to existing hair without incurring the problems associated with the conventional method.

Also, the method of the present invention fills the need for a braided hair style that is available to individuals whose hair may not be suitable for braiding in the conventional manner.

Various modifications may be made of the invention without departing from the scope thereof and it is desired, therefore, that only such limitations shall be placed thereon as are imposed by the prior art and which are set forth in the appended claims.

What is claimed is:

1. A method for attaching pre-manufactured braids to natural hair on a scalp, comprising:

(a) braiding a plurality of manufactured strands of hair to form a base plait;

(b) braiding a second plurality of manufactured strands of hair to form pre-manufactured braids;

(c) anchoring the pre-manufactured braids to the base plait to form an anchored base plait having anchored braids extending therefrom;

(d) braiding the natural hair on the scalp to form rows of braids; and, (e) attaching the anchored base plait to the rows of braids on the scalp.

2. The method of claim 1, wherein the step of attaching the anchored base plait to the rows of braids includes sewing the anchored base plait to the row of braids.

3. The method of claim 1, wherein the steps of braiding a second plurality of manufactured strands of hair and anchoring pre-manufactured braids to the base plait includes looping the second plurality of manufactured strands of hair over the base plait, aligning the ends of the looped manufactured strands, dividing the looped manufactured strands into three strands and braiding the divided strands.

4. The method of claim 1, wherein the step of anchoring the pre-manufactured braids to the base plait includes sewing the pre-manufactured braids to the base plait.

5. The method of claim 1, wherein the step of anchoring the pre-manufactured braids to the base plait includes anchoring the pre-manufactured braids to the base plait with an adhesive substance.

6. A method for attaching pre-manufactured braids to natural hair on a scalp, comprising:

(a) braiding a plurality of manufactured strands of hair to form a base plait;

(b) twisting a second plurality of manufactured strands of hair to form pre-manufactured twists;

(c) anchoring the pre-manufactured twists to the base plait to form an anchored base plait having anchored twists extending therefrom;

(d) braiding the natural hair on the scalp to form rows of braids; and, (e) attaching the anchored base plait to the rows of braids on the scalp.

7. The method of claim 6, wherein the step of attaching the anchored base plait to the rows of braids includes sewing the anchored base plait to the row of braids.

8. The method of claim 6, wherein the steps of twisting a second plurality of manufactured strands of hair and anchoring pre-manufactured twists to the base plait includes looping the second plurality of manufactured strands of hair over the base plait, aligning the ends of the looped manufactured strands, dividing the looped manufactured strands into two strands and twisting the divided strands.

9. The method of claim 6, wherein the step of anchoring the pre-manufactured twists to the base plait includes sewing the pre-manufactured twists to the base plait.

10. The method of claim 6, wherein the step of anchoring the pre-manufactured twists to the base plait includes anchoring the pre-manufactured twists to the base plait with an adhesive substance.

11. A method for attaching pre-manufactured braids to natural hair on a scalp, comprising:

(a) braiding a plurality of manufactured strands of hair to form a base plait;

(b) anchoring a second plurality of manufactured strands of hair to the base plait to form an anchored base plait having anchored strands extending therefrom;

(c) braiding the second plurality of manufactured strands of hair together in combinations of at least three strands;

(d) braiding the natural hair on the scalp to form rows of braids; and, (e) attaching the anchored base plait to the rows of braids.

12. The method of claim 11, wherein the step of attaching the anchored base plait to the rows of braids includes sewing the anchored base plait to the row of braids.

13. The method of claim 11, wherein the step of anchoring the second plurality of manufactured strands of hair to the base plait includes sewing the strands to the base plait.

14. The method of claim 11, wherein the steps of anchoring a second plurality of manufactured strands of hair to the base plait and braiding the second plurality of manufactured strands of hair includes looping the second plurality of manufactured strands of hair over the base plait, aligning the ends of the looped manufactured strands, dividing the looped manufactured strands into three strands and braiding the divided strands.

15. The method of claim 11, wherein the step of anchoring the second plurality of manufactured strands of hair to the base plait includes anchoring the strands of hair to the base plait with an adhesive substance.

* * * * *